US011137184B2

(12) United States Patent
Yamada et al.

(10) Patent No.: US 11,137,184 B2
(45) Date of Patent: Oct. 5, 2021

(54) REFRIGERANT DISTRIBUTOR AND AIR CONDITIONER

(71) Applicant: DAIKIN INDUSTRIES, LTD., Osaka (JP)

(72) Inventors: Kouju Yamada, Osaka (JP); Masanori Jindou, Osaka (JP); Ken Satou, Osaka (JP); Hiroaki Matsuda, Osaka (JP); Kohei Shiomi, Tokyo (JP); Tomoki Yamayoshi, Tokyo (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/965,240

(22) PCT Filed: Jan. 31, 2019

(86) PCT No.: PCT/JP2019/003335
§ 371 (c)(1),
(2) Date: Jul. 27, 2020

(87) PCT Pub. No.: WO2019/151385
PCT Pub. Date: Aug. 8, 2019

(65) Prior Publication Data

US 2020/0370807 A1 Nov. 26, 2020

(30) Foreign Application Priority Data

Jan. 31, 2018 (JP) ..... JP2018-014962

(51) Int. Cl.
*F25B 39/02* (2006.01)
*F25B 39/00* (2006.01)
*F25B 47/00* (2006.01)

(52) U.S. Cl.
CPC ..... *F25B 47/003* (2013.01); *F25B 39/00* (2013.01); *F25B 39/028* (2013.01)

(58) Field of Classification Search
CPC ..... F25B 39/028; F25B 47/003; F28F 19/004; F28F 19/02
See application file for complete search history.

(56) References Cited

U.S. PATENT DOCUMENTS 9,964,367 B2 * 5/2018 Kimata ..... C09D 5/08
10,508,871 B2 * 12/2019 Satake ..... F25B 39/00

FOREIGN PATENT DOCUMENTS

EP 3 244 159 A1 11/2017
WO 2016/002280 A1 1/2016

OTHER PUBLICATIONS

International Preliminary Report of corresponding PCT Application No. PCT/JP2019/003335 dated Aug. 13, 2020.

(Continued)

*Primary Examiner* — Christopher R Zerphey
(74) *Attorney, Agent, or Firm* — Global IP Counselors, LLP

(57) ABSTRACT

A refrigerant distributor includes a first refrigerant pipe, a plurality of second refrigerant pipes, a body, a first plate, and a second plate. The body is made of aluminum or aluminum alloy. The body is configured to distribute a refrigerant from the first refrigerant pipe into the second refrigerant pipes or merge the refrigerant flowing from each of the second refrigerant pipes into the first refrigerant pipe. The body has a first surface connected to the first refrigerant pipe and a second surface connected to the second refrigerant pipes. The first plate is joined to the first surface, and has an outer surface exposed to atmosphere and provided with a first sacrificial anode layer for the body. The second plate is joined to the second surface, and has an outer surface exposed to atmosphere and provided with a second sacrificial anode layer for the body.

13 Claims, 5 Drawing Sheets

(56) References Cited

OTHER PUBLICATIONS

International Search Report of corresponding PCT Application No. PCT/JP2019/003335 dated Apr. 16, 2019.
Fukui et al.; A Study on application of sacrificial anode Al—Zn alloy to aluminum heat exchangers; UDC: 669.715'5: 620.197: 621.1.175; Mar. 7, 1979.
European Search Report of corresponding EP Application No. 19 74 8130.2 dated Feb. 23, 2021.

* cited by examiner

REFRIGERANT DISTRIBUTOR AND AIR CONDITIONER

CROSS-REFERENCE TO RELATED APPLICATIONS

This U.S. National stage application claims priority under 35 U.S.C. § 119(a) to Japanese Patent Application No. 2018-014962, filed in Japan on Jan. 31, 2018, the entire contents of which are hereby incorporated herein by reference.

BACKGROUND

Field of the Invention

The present disclosure provides a refrigerant distributor including a body made of aluminum or an aluminum alloy, and an air conditioner including the refrigerant distributor.

Background Information

Conventional refrigerant distributors include a refrigerant distributor made of aluminum as described in WO 2016/002280 A. In the refrigerant distributor made of aluminum according to 1 WO 2016/002280, corrosion resistance of a part made of the aluminum effects durability of the refrigerant distributer. In a case where the refrigerant distributor includes a body configured to distribute a refrigerant and made of aluminum or an aluminum alloy, the body may be damaged due to corrosion of the aluminum or the aluminum alloy to cause leakage of the refrigerant.

SUMMARY

Examples of a method of improving corrosion resistance of the body include thermally spraying to attach a sacrificial anodic material to the body. In such a case of thermally spraying a sacrificial anode layer, uneven thermal spraying may lead to uneven corrosion resistance.

It is an object of the present disclosure to provide a refrigerant distributor including a body made of aluminum or an aluminum alloy and having evenly improved corrosion resistance.

A refrigerant distributor according to a first aspect includes: a first refrigerant pipe allowing a refrigerant to flow therethrough; a plurality of second refrigerant pipes allowing the refrigerant to flow therethrough; a body made of aluminum or an aluminum alloy, having a first surface connected to the first refrigerant pipe and a second surface connected to the plurality of second refrigerant pipes, configured to distribute the refrigerant flowing from the first refrigerant pipe into the plurality of second refrigerant pipes or merge the refrigerant flowing from each of the second refrigerant pipes into the first refrigerant pipe; a first plate joined to the first surface and having an outer surface that is exposed to atmosphere and is provided with a first sacrificial anode layer for the body; and a second plate joined to the second surface and having an outer surface that is exposed to atmosphere and is provided with a second sacrificial anode layer for the body.

The refrigerant distributor thus configured includes the first and second plates provided with the first and second sacrificial anode layers, respectively, to evenly inhibit corrosion of the body made of the aluminum or the aluminum alloy.

A refrigerant distributor according to a second aspect is the refrigerant distributor according to the first aspect, in which the first refrigerant pipe and the plurality of second refrigerant pipes include a first core material and second core materials each made of aluminum or an aluminum alloy and having a circular tube shape, and third sacrificial anode layers provided on outer circumferential surfaces of the first core material and the second core materials for the first core material and the second core materials. The refrigerant distributor thus configured includes the third sacrificial anode layers that improves corrosion resistance of the first refrigerant pipe and the plurality of second refrigerant pipes, as well as the first sacrificial anode layer and the second sacrificial anode layer that inhibit corrosion of the third sacrificial anode layer disposed adjacent to the body, facilitating further improvement in corrosion resistance of the first refrigerant pipe and the plurality of second refrigerant pipes. A refrigerant distributor according to a third aspect is the refrigerant distributor according to the first or second aspect, in which the body includes a first member made of aluminum or an aluminum alloy and having a cylindrical shape, and a second member having a concave portion receiving the first member and made of a material for the first member, the first member has the first surface on a side opposite to a side fitted into the concave portion, the second member has the second surface on a side opposite to the concave portion, and the concave portion receiving the first member has an internal space for distribution of the refrigerant. The refrigerant distributor thus configured includes the second member having the concave portion surrounded with a thick wall, facilitating improvement in corrosion resistance of a surface other than the first surface and the second surface of the body in accordance with durability extended by the first sacrificial anode layer and the second sacrificial anode layer.

A refrigerant distributor according to a fourth aspect is the refrigerant distributor according to the third aspect, in which the first member and the second member are not provided with any sacrificial anode layer. The refrigerant distributor thus configured includes the body that is provided with no sacrificial anode layer and can be constituted by, for example, an aluminum block or an aluminum alloy block easily obtained to achieve reduction in cost for the refrigerant distributor.

A refrigerant distributor according to a fifth aspect is the refrigerant distributor according to the third or fourth aspect, in which the first member and the first plate have a first fitting hole provided in the first surface and receiving the first refrigerant pipe, and the second member and the second plate have a plurality of second fitting holes provide in the second surface and receiving the plurality of second refrigerant pipes. The refrigerant distributor thus configured includes the first refrigerant pipe surrounded with the first sacrificial anode layer of the first plate, and the plurality of second refrigerant pipes surrounded with the second sacrificial anode layer of the second plate. This configuration achieves improvement in corrosion resistance of a part of the first refrigerant pipe fitted into the first fitting hole and parts of the second refrigerant pipes fitted into the second fitting holes, for provision of the refrigerant distributor that can be easily assembled and has excellent corrosion resistance.

A refrigerant distributor according to a sixth aspect is the refrigerant distributor according to any one of the first to fifth aspects, in which the first plate and the second plate have fool proof structures preventing a side of surface provided with the first sacrificial anode layer and a side of surface provided with the second sacrificial anode layer from joining to the first surface and the second surface, respectively. The refrigerant distributor thus configured has the fool proof structures preventing erroneous assembly such as joining between the first sacrificial anode layer and the first surface or joining between the second sacrificial anode layer and the second surface. Thus, the fool proof structures prevent of a defect of not imparted corrosion resistance or poor corrosion resistance due to erroneous assembly.

A refrigerant distributor according to a seventh aspect is the refrigerant distributor according to any one of the first to sixth aspects, in which the first plate includes a first plate-shaped core material electrochemically superior to the first sacrificial anode layer and circular tube shape is provided directly on the first plate-shaped core material, the second plate includes a second plate-shaped core material electrochemically superior to the second sacrificial anode layer and the second sacrificial anode layer is provided directly on the second plate-shaped core material. In the refrigerant distributor thus configured, the first plate-shaped core material of the first plate provided with the first sacrificial anode layer and the second plate-shaped core material of the second plate provided with the second sacrificial anode layer are higher in electrochemical potential than the first sacrificial anode layer, so as to prevent corrosion of the body as well as reduce corrosion speed of the first plate and the second plate.

A refrigerant distributor according to an eighth aspect is the refrigerant distributor according to the seventh aspect, in which the body is made of an aluminum alloy, and the first plate-shaped core material and the second plate-shaped core material are made of a material for the body.

In the refrigerant distributor thus configured, the first plate-shaped core material of the first plate provided with the first sacrificial anode layer and the second plate-shaped core material of the second plate provided with the second sacrificial anode layer are made of the material for the body, enabling simple estimation of durability relating to corrosion resistance of the first plate-shaped core material, the second plate-shaped core material, and the body, which are assumed as a single component made of a material.

A refrigerant distributor according to a ninth aspect is the refrigerant distributor according to any one of the first to eighth aspects, in which the first plate and the first surface have a joining part including a brazing filler metal, and the second plate and the second surface have a joining part including a brazing filler metal. In the refrigerant distributor thus configured, the brazing filler metal secures preferred entire joining between the first plate and the body, and the brazing filler metal secures preferred entire joining between the second plate and the body, for inhibition of increase in corrosion prevention area through increase in surface area of the body, the first plate-shaped core material, and the second plate-shaped core material due to any gap at any disjoined part, achieving efficient corrosion prevention effect of the first sacrificial anode layer and the second sacrificial anode layer.

An air conditioner according to a tenth aspect includes the refrigerant distributor according to any one of the first to ninth aspects.

The air conditioner thus configured includes the refrigerant distributor having the first and second plates provided with the first and second sacrificial anode layers, respectively, to evenly inhibit corrosion of the body made of the aluminum or the aluminum alloy, of the refrigerant distributor.

DETAILED DESCRIPTION OF EMBODIMENT(S)

DESCRIPTION OF EMBODIMENTS

(1) Entire Configuration

Figure 1:
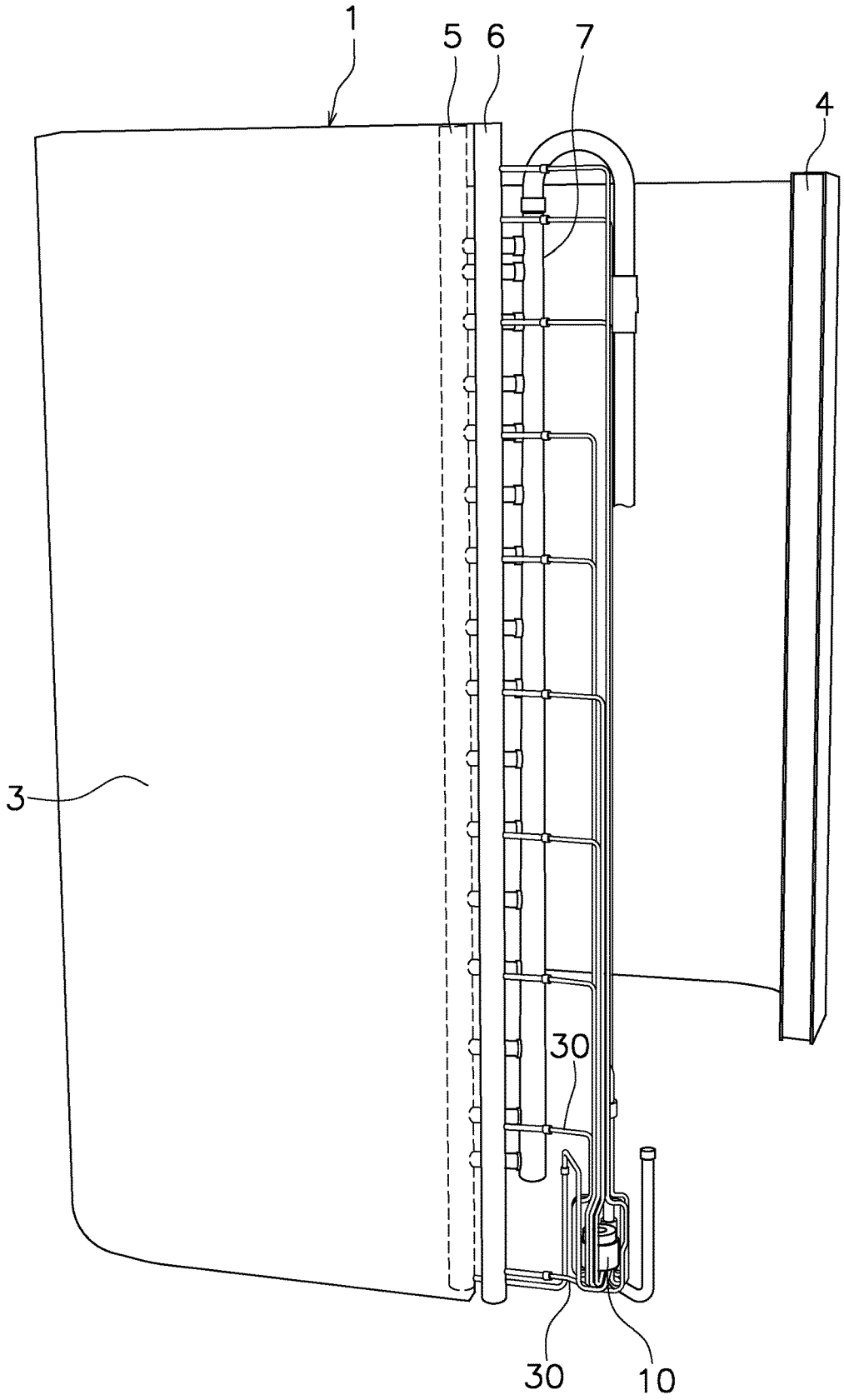
FIG. 1 is a perspective view depicting a heat exchanger including a refrigerant distributor.

As depicted in FIG. 1, a refrigerant distributor 10 is included in a heat source heat exchanger 1, for example, included in an air conditioner. Though not depicted, the air conditioner includes, in addition to the heat source heat exchanger 1, a utilization heat exchanger paired with the heat source heat exchanger 1 for achievement of a vapor compression refrigeration cycle, a compressor configured to circulate a refrigerant flowing to the heat source heat exchanger 1 and the utilization heat exchanger, a four-way valve configured to change a flow of the refrigerant, a fan configured to generate an air flow to the heat exchanger 1, and the like. The air conditioner is configured to switch between cooling operation and heating operation, and the refrigerant flowing in the heat exchanger 1 during cooling operation and the refrigerant flowing in the heat exchanger 1 during heating operation are opposite in direction. Exemplified herein is a case where the refrigerant in the vapor compression refrigeration cycle transitions into a gas refrigerant substantially including a refrigerant in a gas state, a liquid refrigerant substantially including a refrigerant in a liquid state, and a refrigerant in a gas-liquid two-phase state mixedly including a refrigerant in the gas state and a refrigerant in the liquid state. The refrigerant distributor 10 will be described hereinafter, exemplifying a case where the heat exchanger 1 functions as an evaporator. In such a case, a first refrigerant pipe 20 (see FIG. 2) to be described later serves as a refrigerant flow-in pipe, and second refrigerant pipes 30 to be described later serve as refrigerant flow-out pipes.

The heat exchanger 1 includes a heat exchange unit 3 including a plurality of flat tubes made of an aluminum alloy and serving as heat transfer tubes, and a plurality of heat transfer fins made of an aluminum alloy. The plurality of flat tubes in the heat exchange unit 3 is disposed in two rows including an upstream row and a downstream row, and is disposed in a plurality of columns in each of the rows. The heat transfer fins are also disposed in two rows including an upstream row and a downstream row. The plurality of heat transfer fins in each of the rows is spaced apart from each other in a longitudinal direction of the flat tubes, and the heat transfer fins are joined to the flat tubes in the plurality of columns.

The plurality of flat tubes in the upstream row has first ends coupled to first ends of the plurality of flat tubes in the downstream row via a coupling header 4. The refrigerant returns at the coupling header 4 to flow in the flat tubes in the upstream row and flow in the flat tubes in the downstream row. The plurality of flat tubes in the downstream row has second ends connected to a first header collecting pipe 5 made of an aluminum alloy, and the plurality of flat tubes in the upstream row has second ends connected to a second header collecting pipe 6 made of an aluminum alloy. The first header collecting pipe 5 is connected to a gas collecting pipe 7 made of an aluminum alloy. The first header collecting pipe 5 and the gas collecting pipe 7 allow mainly the gas refrigerant to flow therethrough.

The refrigerant distributor 10 is connected to the second refrigerant pipes 30 as a plurality of branch pipes made of an aluminum alloy and extending from the second header collecting pipe 6. The refrigerant flows out of the second refrigerant pipes 30 to the second header collecting pipe 6 in an exemplary case where the heat exchanger 1 functions as an evaporator during heating operation of the air conditioner. The refrigerant distributor 10 will be described below in a case where the heat exchanger 1 functions as an evaporator and the refrigerant distributor 10 distributes a liquid refrigerant. The refrigerant distributor 10 also functions as a merger configured to receive the refrigerant from each of the second refrigerant pipes 30 during cooling operation while the heat exchanger 1 functions as a condenser. In an exemplary case where the heat exchanger 1 functions as a condenser and the refrigerant distributor 10 functions as a merger, the first refrigerant pipe 20 serves as a refrigerant flow-out pipe and the second refrigerant pipes 30 serve as refrigerant flow-in pipes. In such a case, a body 40 to be described later merges the refrigerant flowing from each of the second refrigerant pipes 30 into the first refrigerant pipe 20.

Figure 2:
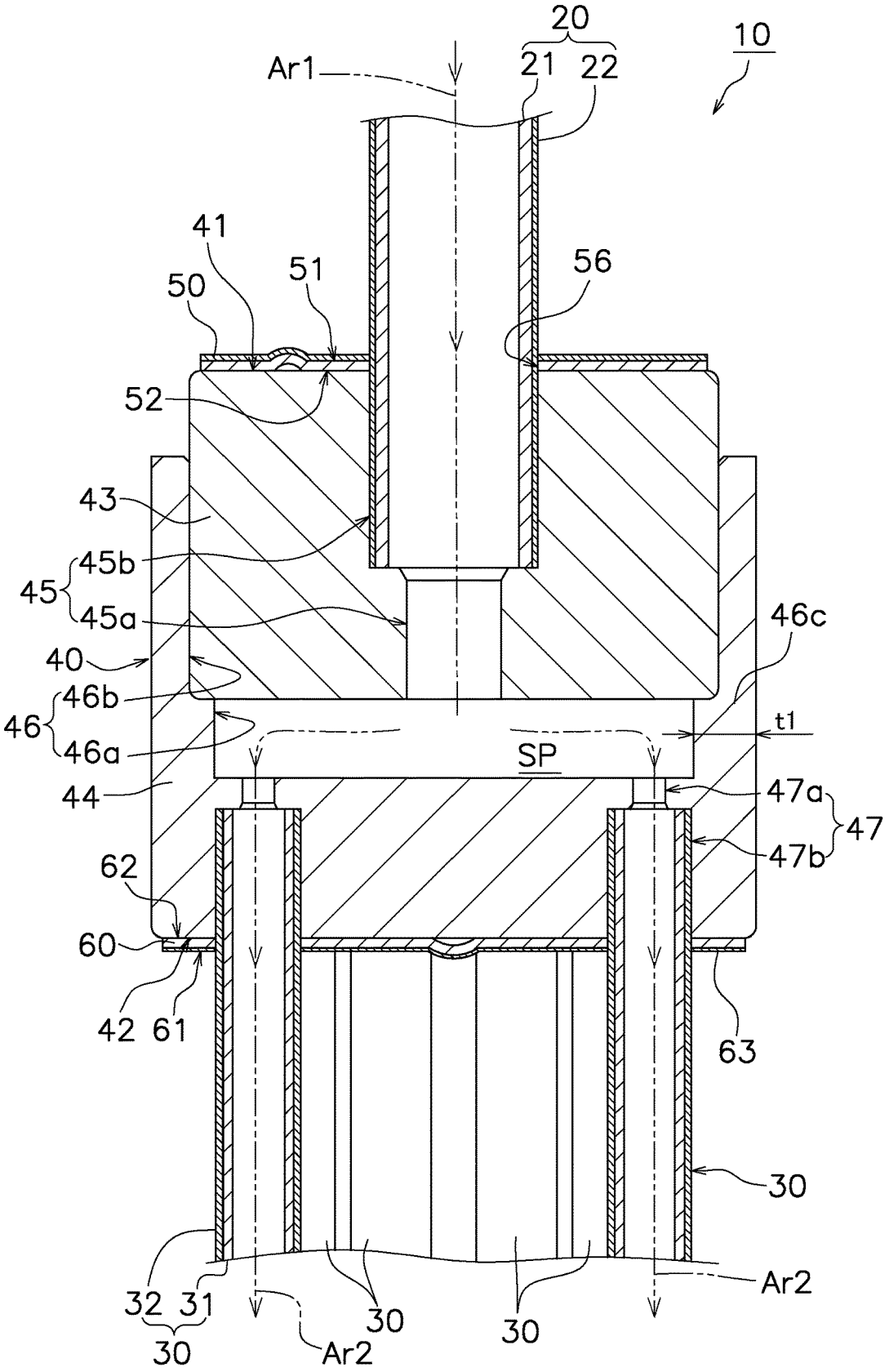
FIG. 2 is a sectional view depicting an exemplary configuration of the refrigerant distributor.
Figure 3:
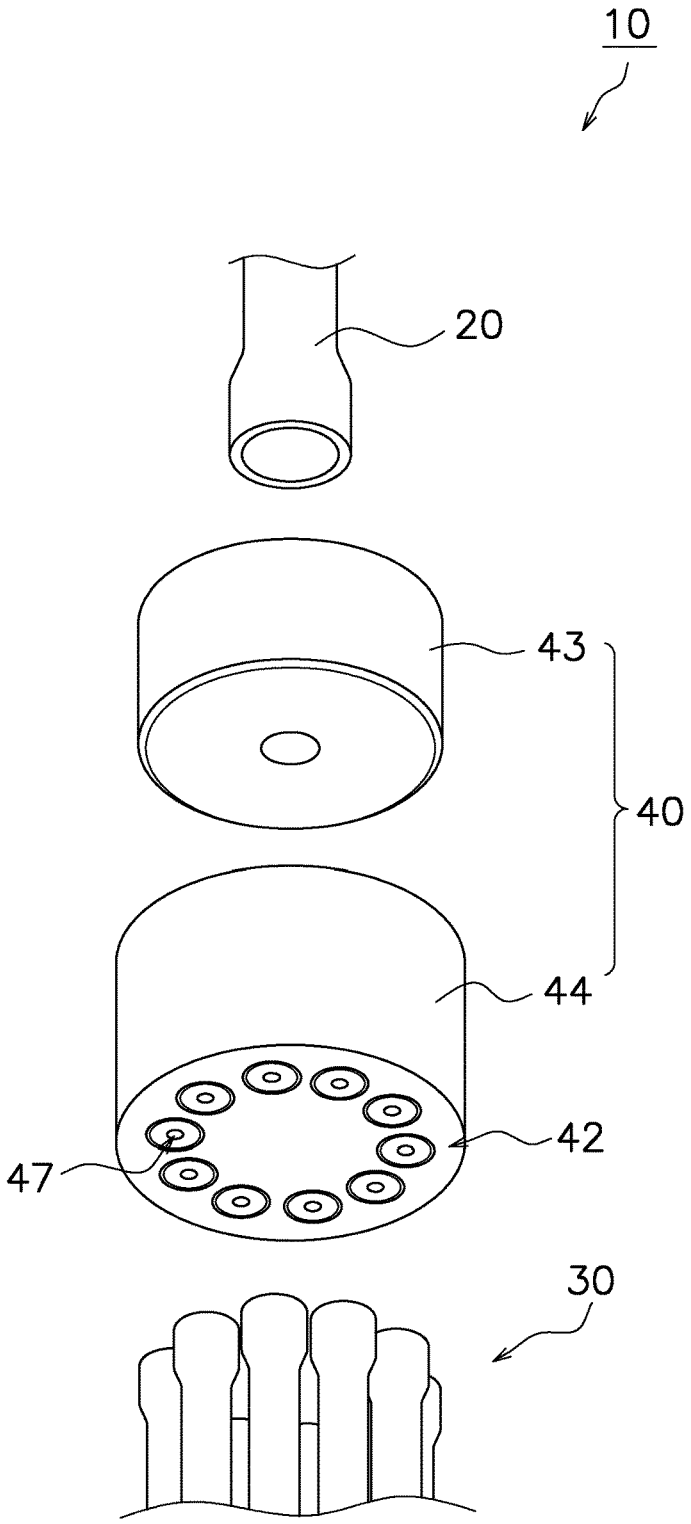
FIG. 3 is an exploded perspective view of the refrigerant distributor depicted in FIG. 2.

As depicted in FIG. 2 and FIG. 3, the refrigerant distributor 10 includes the first refrigerant pipe 20, the plurality of second refrigerant pipes 30, the body 40, a first plate 50, and a second plate 60. FIG. 2 depicts a section of the refrigerant distributor 10 having been assembled. FIG. 3 depicts states of the first refrigerant pipe 20, the plurality of second refrigerant pipes 30, and the body 40 before the refrigerant distributor 10 is assembled.

The first refrigerant pipe 20 allows a refrigerant flowing into the refrigerant distributor 10 to flow therethrough. FIG. 2 includes arrow Ar1 indicating a flow of the inflowing refrigerant. The plurality of second refrigerant pipes 30 allows a refrigerant flowing out of the refrigerant distributor 10 to flow therethrough. FIG. 2 includes arrow Ar2 indicating a flow of the outflowing refrigerant. The body 40 has a first surface 41 connected to the first refrigerant pipe 20 and a second surface 42 connected to the plurality of second refrigerant pipes 30. The body 40 distributes the refrigerant from the first refrigerant pipe 20 into the plurality of second refrigerant pipes 30. The refrigerant distributor 10 is connected to ten second refrigerant pipes 30, so that the inflowing refrigerant is equally distributed to ten portions so as to flow through the ten second refrigerant pipes 30 and then flow out. The description refers to the case where only one first refrigerant pipe 20 is connected, but there may alternatively be provided a plurality of first refrigerant pipes 20. The number of the second refrigerant pipes 30 is not limited to ten, but has only to be more than the number of the first refrigerant pipes 20. The refrigerant distributor is not necessarily designed to equally distribute the refrigerant into the plurality of second refrigerant pipes 30, but may alternatively be designed to distribute the refrigerant to have different flow rates in the plurality of second refrigerant pipes 30.

The first plate 50 has a second principal surface 52 joined to the first surface 41 of the body 40. The second plate 60 has a second principal surface 62 joined to the second surface 42 of the body 40. The first plate 50 has a first principal surface 51 that is exposed to atmosphere and is provided with a first sacrificial anode layer 54 (see FIG. 4) for the body 40. The second plate 60 has a first principal surface 61 that is exposed to atmosphere and is provided with a second sacrificial anode layer 64 (see FIG. 5) for the body 40.

The body 40 is made of an aluminum alloy. Examples of the aluminum alloy as the material for the body 40 include an aluminum alloy provided with manganese (M) as an additive (an Al—Mn aluminum alloy). Examples of the Al—Mn aluminum alloy include an aluminum alloy having an alloy number in the 3000s prescribed by the Japan Industrial Standards (e.g. JISH4040). The first sacrificial anode layer 54 for the body 40 is electrochemically inferior to the body 40. In other words, the body 40 is made of a metal electrochemically superior to the first sacrificial anode layer 54. In still other words, the body 40 is made of a metal higher in electrochemical potential than the first sacrificial anode layer 54. The second sacrificial anode layer 64 for the body 40 is electrochemically inferior to the body 40. In an exemplary case where the first surface 41 of the body 40 is provided with dew condensation water, rainwater, or the like, the first sacrificial anode layer 54 electrochemically inferior to the body 40 made of the aluminum alloy is higher in ionization tendency than the body 40. Even when moisture adheres to the body 40 adjacent to the first sacrificial anode layer 54, the first sacrificial anode layer 54 supplies the body 40 with electrons for corrosion prevention. The first sacrificial anode layer 54 and the body 40 are electrically connected to each other so that the first sacrificial anode layer 54 supplies the body 40 with electrons. Similarly, the body 40 is prevented from corrosion also on the second surface 42 by sacrificial anodic effect of the second sacrificial anode layer 64.

(2) Detailed Configurations (2-1) Body 40

The body 40 includes a first member 43 and a second member 44. The first member 43 and the second member 44 are preferably made of an identical material in terms of corrosion prevention. The first member 43 and the second member 44 are made of an identical aluminum alloy, namely, an Al—Mn aluminum alloy. The first member 43 has a columnar shape and is provided with a first hole 45, whereas the second member 44 has a topped cylindrical shape having a top surface provided with a plurality of second holes 47. The second member 44 has a concave portion 46 into which the first member 43 is fitted.

Neither the first member 43 nor the second member 44 of the body 40 is provided with any sacrificial anode layer. In other words, the first member 43 and the second member 44 are made of a single Al—Mn aluminum alloy.

The concave portion 46 includes a circular opening **46*b* having a larger diameter and disposed in a shallow part of the concave portion 46, and a circular opening 46*a* having a smaller diameter and disposed in a deep part of the concave portion 46 and continuously from the circular opening 46*b*. The circular openings 46*a* and 46*b* have center axes matching a center axis of the second member 44. The circular opening 46*b* has the larger diameter that is equal to or slightly larger than an outer diameter of the first member 43, and constitutes a part into which the first member 43 is fitted. In the state where the first member 43 is fitted to the second member 44, the circular opening 46*a* having the small diameter serves as a space SP for refrigerant distribution. The first member 43 has an outer surface including a part in contact with the concave portion 46 of the second member 44, and the part is furnace brazed with a ring brazing filler metal processed to have a ring shape or a brazing filler metal clad to an outer circumferential surface of the first member 43. Examples of the ring brazing filler metal or the clad brazing filler metal include an aluminum alloy. Such furnace brazing allows the first member 43 and the second member 44** to be airtightly joined to each other.

The first member 43 is provided with the first hole 45 having a columnar shape and a center axis matching a center axis of the first member 43. The first hole 45 includes a circular opening 45*b* having a larger diameter and disposed adjacent to the first surface 41, and a circular opening 45*a* having a smaller diameter and disposed far from the first surface 41 and continuously from the circular opening 45*b*. The circular opening 45*b* having the larger diameter receives the first refrigerant pipe 20 having a cylindrical shape. The refrigerant flowing into the refrigerant distributor 10 flows from the first refrigerant pipe 20, passes the circular opening 45*a*, and flows into the circular opening 46*a* serving as the space SP for refrigerant distribution.

The second member 44 is provided with ten second holes 47 disposed to be equally spaced apart from each other on a circumference having a center matching the center axis of the second member 44. The second holes 47 extend along the center axis of the second member 44 having the cylindrical shape. The second holes 47 each include a circular opening 47*b* having a larger diameter and disposed adjacent to the second surface 42, and a circular opening 47*a* having a smaller diameter and disposed far from the second surface 42 and continuously from the circular opening 47*b*. Each of the circular openings 47*b* having the larger diameter receives a corresponding one of the second refrigerant pipes 30. The refrigerant flows out of the refrigerant distributor 10 through the circular opening 46*a* serving as the space SP for refrigerant distribution, the circular openings 47*a*, and then the second refrigerant pipes 30.

The circular opening 45*b* and the circular openings 47*b* in the body 40 may each have a depth of 6 mm or more. The circular opening 46*a* in the second member 44 is surrounded with a cylindrical wall 46*c* including a thinnest part having a thickness t1 that is one of important factors for durability of the refrigerant distributor 10. The thickness t1 of the thinnest part of the cylindrical wall 46*c* is set to a level preventing the thinnest part of the cylindrical wall 46*c* from being penetrated due to pitting corrosion during a Sea Water Acidified Test (SWAAT, ASTM G85-A3) even when a part of a third sacrificial anode layer 22 or 32, which will be described later, positioned in the circular opening 45*b* or 47*b* is corroded to be eliminated. The thickness t1 may be set to be more than a depth of the pitting corrosion in the cylindrical wall 46*c* when the SWAAT lasts 4900 hours. The thickness t1 is thus preferred to be 3 mm or more.

(2-2) First Refrigerant Pipe 20

The first refrigerant pipe 20 includes a first core material 21 made of an aluminum alloy and having a circular tube shape, and the third sacrificial anode layer 22 provided entirely on an outer circumferential surface of the first core material 21. The first core material 21 and the body 40 are preferably made of an identical material in terms of corrosion prevention. The first core material 21 is made of an Al—Mn aluminum alloy in this case. Examples of the aluminum alloy as a material for the third sacrificial anode layer 22 include an aluminum alloy provided with zinc (Zn) and magnesium (Mg) as additives (an Al—Zn—Mg aluminum alloy). Examples of the Al—Zn—Mg aluminum alloy include an aluminum alloy having an alloy number in the 7000s prescribed by JISH4080. The Al—Zn—Mg aluminum alloy as the material for the third sacrificial anode layer 22 is set to be a less-noble metal than the Al—Mn aluminum alloy as the material for the first core material 21.

The third sacrificial anode layer 22 is a clad layer provided entirely on an outer circumferential surface of the first refrigerant pipe 20. The first refrigerant pipe 20 having the third sacrificial anode layer 22 clad to the entire outer circumferential surface can be obtained at a low cost, for example, by pressure bonding. For example, such pressure bonding can be achieved by hot extrusion processing. The first refrigerant pipe 20 is simply fitted into the circular opening 45*b* in the body 40. The first refrigerant pipe 20 may be joined to the body 40 through furnace brazing with use of a ring brazing filler metal preliminarily provided in the circular opening 45*b* before the first refrigerant pipe 20 is inserted. The third sacrificial anode layer 22 of the first refrigerant pipe 20 is accordingly joined to an inner circumferential surface of the circular opening 45*b*.

The third sacrificial anode layer 22 extends to reach the interior of the circular opening 45*b* in the body 40. The body 40 is thus highly possibly damaged to cause leakage of the refrigerant if the third sacrificial anode layer 22 is eliminated. Removal of the third sacrificial anode layer 22 positioned in the circular opening 45*b* and direct joining between the first core material 21 and the body 40 will prevent a defect that the refrigerant is likely to leak due to corrosion of the third sacrificial anode layer 22 positioned in the circular opening 45*b*. Partial removal of the third sacrificial anode layer 22 will lead to increase in cost for the first refrigerant pipe 20 because of removal work. In view of this, the refrigerant distributor 10 includes the first sacrificial anode layer 54 of the first plate 50, which will be described later and inhibits corrosion of the third sacrificial anode layer 22 for inhibition of the defect described above.

(2-3) Second Refrigerant Pipe 30

Each of the second refrigerant pipes 30 includes a second core material 31 made of an aluminum alloy and having a circular tube shape, and the third sacrificial anode layer 32 provided entirely on an outer circumferential surface of the second core material 31. The second core material 31 and the body 40 are preferably made of an identical material in terms of corrosion prevention. The second core material 31 is made of an Al—Mn aluminum alloy in this case. The third sacrificial anode layer 32 of each of the second refrigerant pipes 30 and the third sacrificial anode layer 22 of the first refrigerant pipe 20 are made of an identical material in this case. Similarly to the first refrigerant pipe 20, each of the second refrigerant pipes 30 includes the third sacrificial anode layer 32 made of the material that is set to be a less-noble metal than the material for the second core material 31.

The third sacrificial anode layers 32 are clad layers provided entirely on outer circumferential surfaces of the second refrigerant pipes 30. The second refrigerant pipes 30 each having the third sacrificial anode layer 32 clad to the entire outer circumferential surface can be obtained at a low cost, for example, by pressure bonding. For example, such pressure bonding can be achieved by hot extrusion processing. The second refrigerant pipes 30 are simply fitted into the circular openings 47*b* in the body 40. Each of the second refrigerant pipes 30 may be joined to the body 40 through furnace brazing with use of a ring brazing filler metal preliminarily provided in a corresponding one of the circular openings 47*b* before the second refrigerant pipe 30 is inserted. The third sacrificial anode layer 32 of the second refrigerant pipe 30 is accordingly joined to an inner circumferential surface of the circular opening 47*b*.

Each of the third sacrificial anode layers 32 extends to reach the interior of the corresponding one of the circular openings 47*b* in the body 40. The body 40 is thus highly possibly damaged to cause leakage of the refrigerant if the third sacrificial anode layer 32 is eliminated. Removal of each of the third sacrificial anode layers 32 positioned in the corresponding one of the circular openings 47*b* and direct joining between the second core material 31 and the body 40 will prevent a defect that the refrigerant is likely to leak due to corrosion of the third sacrificial anode layer 32 positioned in the corresponding circular opening 47*b*. Partial removal of the third sacrificial anode layers 32 will lead to increase in cost for the second refrigerant pipes 30 due to removal work. In view of this, the refrigerant distributor 10 includes the second sacrificial anode layer 64 of the second plate 60, which will be described later and inhibits corrosion of the third sacrificial anode layers 32 for inhibition of the defect described above.

(2-4) First Plate 50

Figure 4:
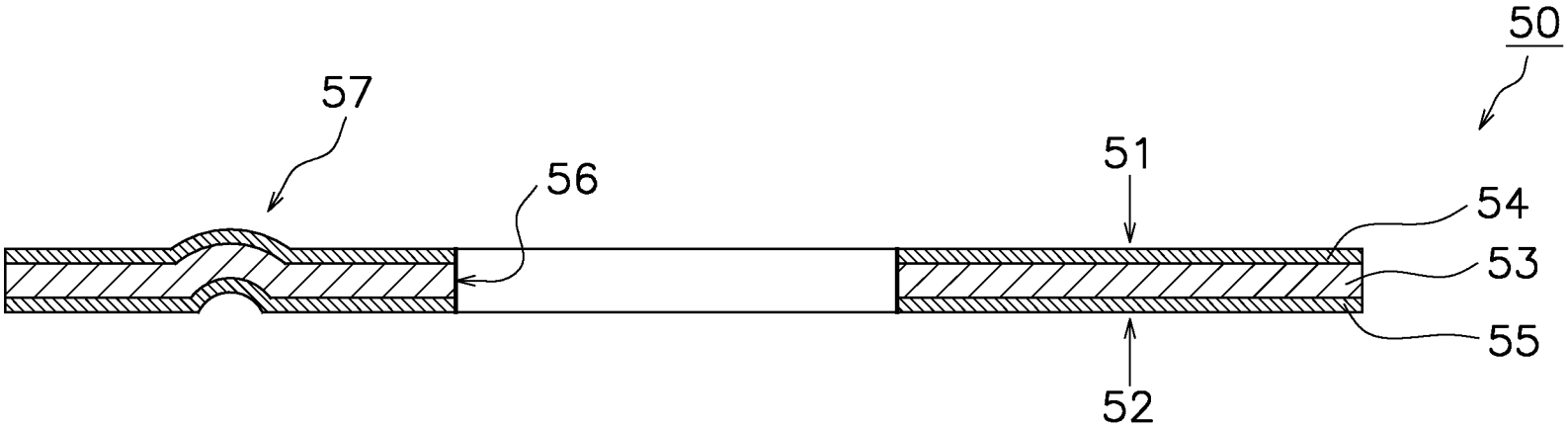
FIG. 4 is a sectional view depicting an exemplary configuration of a first plate.

As in FIG. 4 depicting the first plate 50 before being joined to the body 40, the first plate 50 has the first principal surface 51 and the second principal surface 52. The first plate 50 before being joined to the body 40 includes a first plate-shaped core material 53 made of a material identical to the material for the body 40, the first sacrificial anode layer 54 provided directly on the first plate-shaped core material 53 and disposed on the first principal surface 51, and a brazing filler metal layer 55 provided entirely on the second principal surface 52. The first sacrificial anode layer 54 and the brazing filler metal layer 55 disposed on the respective surfaces of the first plate-shaped core material 53 are clad to the first plate-shaped core material 53, for example, by pressure bonding. The first plate 50 may have a thickness from 1 mm to 2 mm. The first plate 50 has the first principal surface 51 exposed to atmosphere and the second principal surface 52 joined to the first surface 41 of the body 40.

The first plate-shaped core material 53 and the body 40 are preferably made of an identical material. The first plate-shaped core material 53 is made of an Al—Mn aluminum alloy in this case. The first sacrificial anode layer 54 may be made of an Al—Zn—Mg aluminum alloy. When the Al—Mn aluminum alloy as the material for the first plate-shaped core material 53 is compared with the material for the first sacrificial anode layer 54, the material for the first sacrificial anode layer 54 is set to be a less-noble metal than the material for the body 40 and the first plate-shaped core material 53. In other words, the first plate-shaped core material 53 is made of a metal electrochemically superior to the first sacrificial anode layer 54. In still other words, the first plate-shaped core material 53 is higher in electrochemical potential than the first sacrificial anode layer 54. In order to achieve preferred sacrificial anodic effect, the first sacrificial anode layer 54 has a surface different by at least 100 mV as an electrochemical potential difference from the body 40 and the first plate-shaped core material 53. The first sacrificial anode layer 54 and the third sacrificial anode layer 22 are made of an identical material. When the material for the first sacrificial anode layer 54 is set to be a less-noble metal than the material for the first plate-shaped core material 53, the body 40 and the first plate-shaped core material 53 have an interface less likely to be corroded.

The brazing filler metal layer 55 is preferably made of an aluminum alloy. The brazing filler metal layer 55 may be made of an aluminum alloy provided with silicon (Si) as an additive (an Al—Si aluminum alloy). Examples of the Al—Si aluminum alloy include an aluminum alloy having an alloy number in the 4000s prescribed by JISH4000.

The first plate 50 is provided with an opening 56 into which the first refrigerant pipe 20 is fitted. The opening 56 has a center axis substantially matching the center axis of the first hole 45. The opening 56 has a diameter set to be equal to or more than a diameter of the circular opening 45*b* of the first hole 45. The circular opening 45*b* in the first member 43 of the body 40 and the opening 56 in the first plate 50 constitute a first fitting hole into which the first refrigerant pipe 20 is fitted. In order to cause the first sacrificial anode layer 54 of the first plate 50 to inhibit corrosion of the third sacrificial anode layer 22 positioned in the circular opening 45*b*, it is preferred that the diameter of the opening 56 is small and the first plate 50 is in contact with the first refrigerant pipe 20. The effect of inhibiting the corrosion of the third sacrificial anode layer 22 may be obtained if the first plate 50 is disposed adjacent to the first refrigerant pipe 20 without being in contact with the first refrigerant pipe 20. Even in a case where the diameter of the opening 56 is larger than the diameter of the circular opening 45*b*, for example, by several millimeters, corrosion of the third sacrificial anode layer 22 can be inhibited sufficiently.

The first plate 50 has a fool proof structure preventing the first sacrificial anode layer 54 from joining to the first surface 41 of the body 40. The first plate 50 has the fool proof structure constituted by a projection 57 toward the first sacrificial anode layer 54. When the first sacrificial anode layer 54 is attached to the first surface 41 of the body 40 in order to join the first plate 50 to the first surface 41, the projection 57 thus provided hits the first surface 41 and the first plate 50 is lifted from the body 40 to prevent the first sacrificial anode layer 54 from joining to the first surface 41 of the body 40. The fool proof structure is configured to prevent joining when a worker erroneously attaches an erroneous surface of the first plate 50 and/or the second plate 60, or to notify a worker that such joining is incorrect.

(2-5) Second Plate 60

Figure 5:
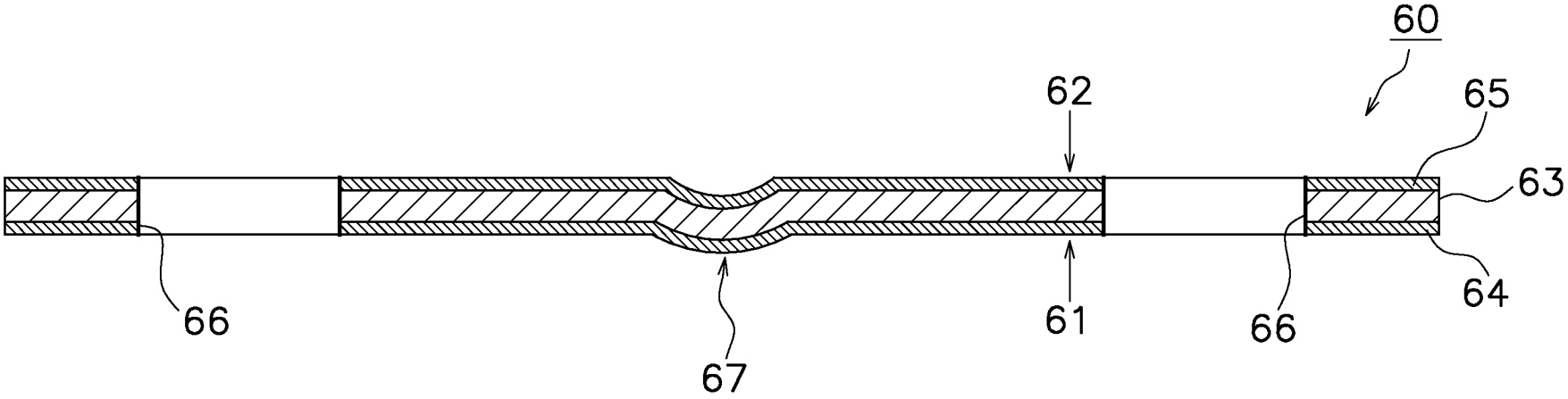
FIG. 5 is a sectional view depicting an exemplary configuration of a second plate.

As in FIG. 5 depicting the second plate 60 before being joined to the body 40, the second plate 60 has the first principal surface 61 and the second principal surface 62. The second plate 60 before being joined to the body 40 includes a second plate-shaped core material 63 made of a material identical to the material for the body 40, the second sacrificial anode layer 64 provided directly on the second plate-shaped core material 63 and disposed on the first principal surface 61, and a brazing filler metal layer 65 provided entirely on the second principal surface 62. The second sacrificial anode layer 64 and the brazing filler metal layer 65 disposed on the respective surfaces of the second plate-shaped core material 63 are clad to the second plate-shaped core material 63, for example, by pressure bonding. The second plate 60 may have a thickness from 1 mm to 2 mm. The second plate 60 has the first principal surface 61 exposed to atmosphere and the second principal surface 62 joined to the second surface 42 of the body 40.

The second plate-shaped core material 63 and the body 40 are preferably made of an identical material. The second plate-shaped core material 63 is made of an Al—Mn aluminum alloy in this case. The second sacrificial anode layer 64 may be made of an Al—Zn—Mg aluminum alloy. When the Al—Mn aluminum alloy as the material for the second plate-shaped core material 63 is compared with the material for the second sacrificial anode layer 64, the material for the second sacrificial anode layer 64 is set to be a less-noble metal than the material for the second plate-shaped core material 63. In other words, the second plate-shaped core material 63 is made of a metal electrochemically superior to the second sacrificial anode layer 64. In still other words, the body 40 and the second plate-shaped core material 63 are higher in electrochemical potential than the second sacrificial anode layer 64. In order to achieve preferred sacrificial anodic effect, the second sacrificial anode layer 64 has a surface different by at least 100 mV as an electrochemical potential difference from the body 40 and the second plate-shaped core material 63. The second sacrificial anode layer 64 and the third sacrificial anode layer 32 are made of an identical material. When the material for the second sacrificial anode layer 64 is set to be a less-noble metal than the material for the second plate-shaped core material 63, the body 40 and the second plate-shaped core material 63 have an interface less likely to be corroded.

The brazing filler metal layer 65 is preferably made of an aluminum alloy. The brazing filler metal layer 65 may be made of an aluminum alloy provided with silicon (Si) as an additive (an Al—Si aluminum alloy). Examples of the Al—Si aluminum alloy include an aluminum alloy having an alloy number in the 4000s prescribed by JISH4000.

The second plate 60 is provided with a plurality of openings 66 into which the ten second refrigerant pipes 30 are fitted. The openings 66 have center axes substantially matching center axes of the second holes 47. The openings 66 have a diameter set to be equal to or more than a diameter of the circular openings 47*b* of the second holes 47. The circular openings 47*b* in the second member 44 of the body 40 and the openings 66 in the second plate 60 constitute second fitting holes into which the second refrigerant pipes 30 are fitted. In order to cause the second sacrificial anode layer 64 of the second plate 60 to inhibit corrosion of the third sacrificial anode layer 32 positioned in each of the circular openings 47*b*, it is preferred that the diameter of the openings 66 is small and the second plate 60 is in contact with the second refrigerant pipes 30. The effect of inhibiting the corrosion of the third sacrificial anode layer 32 may be obtained if the second plate 60 is disposed adjacent to the second refrigerant pipes 30 without being in contact with the second refrigerant pipes 30. Even in a case where the diameter of the openings 66 is larger than the diameter of the circular openings 47*b*, for example, by several millimeters, corrosion of the third sacrificial anode layer 32 can be inhibited sufficiently.

The second plate 60 has a fool proof structure preventing the second sacrificial anode layer 64 from joining to the second surface 42 of the body 40. The second plate 60 has the fool proof structure constituted by a projection 67 toward the second sacrificial anode layer 64. When the second sacrificial anode layer 64 is attached to the second surface 42 of the body 40 in order to join the second plate 60 to the second surface 42, the projection 67 thus provided hits the second surface 42 and the second plate 60 is lifted from the body 40 to prevent the second sacrificial anode layer 64 from joining to the second surface 42 of the body 40.

(3) Characteristics (3-1)

The first plate 50 is joined to the first surface 41 of the body 40, and the second plate 60 is joined to the second surface 42 of the body 40. The first plate 50 has the first principal surface 51 as an outer surface exposed to atmosphere and provided with the first sacrificial anode layer 54, and the second plate 60 has the first principal surface 61 as an outer surface exposed to atmosphere and provided with the second sacrificial anode layer 64. The first sacrificial anode layer 54 and the second sacrificial anode layer 64 for the body 40 are electrochemically inferior to the body 40. In an environment where the refrigerant distributor 10 is corroded, the first sacrificial anode layer 54 and the second sacrificial anode layer 64 exhibit sacrificial anodic effect by supplying the body 40 with electrons and being corroded before the body 40 is corroded to inhibit corrosion of the body 40.

The first sacrificial anode layer 54 and the second sacrificial anode layer 64 layered on the first plate 50 and the second plate 60 can have a desired thickness easily set in accordance with durability of the refrigerant distributor 10 made of an aluminum alloy, because the first sacrificial anode layer 54 and the second sacrificial anode layer 64 are not provided through thermal spraying. The first sacrificial anode layer 54 and the second sacrificial anode layer 64 can thus evenly inhibit corrosion of the body 40 in accordance with a set period of durability at portions desired to have higher corrosion resistance by means of the first plate 50 and the second plate 60.

(3-2)

The first core material 21 of the first refrigerant pipe 20 and the second core materials 31 of the second refrigerant pipes 30 are made of the aluminum alloy. The third sacrificial anode layers 22 and 32 inhibit corrosion of the first core material 21 and the second core materials 31. The third sacrificial anode layers 22 and 32 are influenced by the first core material 21 and the second core materials 31, as well as the body 40 made of the aluminum alloy. If the refrigerant distributor 10 is provided with neither the first sacrificial anode layer 54 nor the second sacrificial anode layer 64, the third sacrificial anode layers 22 and 32 are more likely to be corroded rapidly at portions adjacent to the body 40 than remaining portions far from the body 40. Particularly in a case where the third sacrificial anode layers 22 and 32 in the circular openings 45*b* and 47*b* are corroded rapidly, the first core material 21 and the second core materials 31 may have gaps from the circular openings 45*b* and 47*b* to increase risk of leakage of the refrigerant. The first sacrificial anode layer 54 and the second sacrificial anode layer 64 inhibit corrosion of the third sacrificial anode layers 22 and 32 adjacent to the body 40, for improvement in corrosion resistance of the first refrigerant pipe 20 and the plurality of second refrigerant pipes 30.

(3-3)

Increasing the thickness t1 of the cylindrical wall 46*c* surrounding the concave portion 46 in the second member 44 leads to extension of a period until the refrigerant leaks due to pitting corrosion in the cylindrical wall 46*c*. The first sacrificial anode layer 54 and the second sacrificial anode layer 64 inhibit corrosion of the first surface 41 and the second surface 42 of the body 40 to extend the period of durability against corrosion. Thickening the cylindrical wall 46*c* surrounding the concave portion 46 in the second member 44 facilitates improvement in corrosion resistance of the entire body 40 according to the period of durability of the portions extended by the first sacrificial anode layer 54 and the second sacrificial anode layer 64.

(3-4)

In the body 40, neither the first member 43 nor the second member 44 made of the aluminum alloy is provided with any sacrificial anode layer. Each of the first member 43 and the second member 44 can be formed by cutting a block made of the aluminum alloy such as a bar member made of the aluminum alloy. The body 40 that can be constituted by an aluminum block or an aluminum alloy block easily obtained leads to provision of the refrigerant distributor 10 at a lower cost in comparison to a case of processing members such as the first member 43 and the second member 44 each provided directly with the sacrificial anode layer.

(3-5)

The first refrigerant pipe 20 provided on the outer circumferential surface with the third sacrificial anode layer 22 is simply fitted into the first fitting hole constituted by the circular opening 45*b* in the first member 43 and the opening 56 in the first plate 50 for easier assembly, and the first sacrificial anode layer 54 inhibits corrosion of the third sacrificial anode layer 22 for lasting corrosion resistance. Similarly, the second refrigerant pipes 30 each provided on the outer circumferential surface with the third sacrificial anode layer 32 are simply fitted into the second fitting holes constituted by the circular openings 47*b* in the second member 44 and the openings 66 in the second plate 60 for easier assembly, and the second sacrificial anode layer 64 inhibits corrosion of the third sacrificial anode layer 32 for lasting corrosion resistance. This configuration achieves provision of the refrigerant distributor 10 that is easily assembled and has excellent corrosion resistance.

(3-6)

The above embodiment provides the fool proof structures exemplified by the projection 57 of the first plate 50 and the projection 67 of the second plate 60. The projections 57 and 67 prevent erroneous assembly such as joining the first sacrificial anode layer 54 to the first surface 41 and joining the second sacrificial anode layer 64 to the second surface 42. These projections 57 and 67 prevent a defect of not imparted corrosion resistance or poor corrosion resistance due to erroneous assembly.

(3-7)

The first plate-shaped core material 53 of the first plate 50 is electrochemically superior to the first sacrificial anode layer 54, and the second plate-shaped core material 63 of the second plate 60 is electrochemically superior to the second sacrificial anode layer 64. This configuration prevents corrosion of the body 40 as well as reduces corrosion speed of the first plate 50 and the second plate 60.

(3-8)

The first plate 50 and the second plate 60 include the first plate-shaped core material 53 and the second plate-shaped core material 63 made of the Al—Mn aluminum alloy as the material for the body 40. The first plate 50 and the second plate 60 are made of the aluminum alloy as the material for the body 40. In comparison to a case where the first plate 50 and the second plate 60 are made of a material different from the material for the body 40, the above configuration refrains from complicated corrosion inhibition by the first sacrificial anode layer 54 and the second sacrificial anode layer 64 provided directly on the first plate-shaped core material 53 and the second plate-shaped core material 63. The first plate-shaped core material 53, the second plate-shaped core material 63, and the body 40 can thus be regarded as a single component made of a material for simple estimation of durability relating to corrosion resistance.

(3-9)

The first plate 50 and the first surface 41 have a joining part, and the second plate 60 and the second surface 42 have a joining part, and each of the joining parts has the brazing filler metal made of the Al—Si aluminum alloy in the above embodiment. These brazing filler metals secure preferred entire joining between the first plate 50 and the body 40 and preferred entire joining between the second plate 60 and the body 40, for inhibition of increase in corrosion prevention area through increase in surface area of the body 40, the first plate-shaped core material 53, and the second plate-shaped core material 63 caused by any gap at any disjoined part, achieving efficient corrosion prevention by the first sacrificial anode layer 54 and the second sacrificial anode layer 64.

(4) Modification Examples (4-1) Modification Example 1A

The above embodiment exemplifies the body 40 made of the aluminum alloy. The body 40 may alternatively be made of aluminum. For the body 40 made of the aluminum, the first sacrificial anode layer 54 and the second sacrificial anode layer 64 are each made of a less-noble metal than the aluminum. Examples of the aluminum include aluminum having an alloy number in the 1000s prescribed by JISH4040. Also for such a body made of aluminum, a layer made of an Al—Zn—Mg aluminum alloy may be applied as the first sacrificial anode layer 54 or the second sacrificial anode layer 64. Similarly, the heat exchange unit 3, the coupling header 4, the first header collecting pipe 5, the second header collecting pipe 6, the first core material 21 of the first refrigerant pipe 20, and the second core materials 31 of the second refrigerant pipes 30 may alternatively be made of aluminum. For the first core material 21 and the second core material 31 made of aluminum, the third sacrificial anode layers 22 and 32 are each made of a metal electrochemically inferior to aluminum.

(4-2) Modification Example 1B

The body 40 according to the above embodiment has the first surface 41 and the second surface 42 being flat, so that the first plate 50 and the second plate 60 are also flat. The first plate 50 and the second plate 60 are not limitedly flat. In a case where the first surface 41 and the second surface 42 are curved, the first plate 50 and the second plate 60 may be curved in accordance with the first surface 41 and the second surface 42. The above embodiment exemplifies the case where the single first plate 50 is joined to the first surface 41 and the single second plate 60 is joined to the second surface 42. Each of the first plate 50 and the second plate 60 may alternatively be divided into a plurality of parts. Still alternatively, the body 40 may have a cylindrical side surface joined to a plate provided with a sacrificial anode layer.

(4-3) Modification Example 1C

The above embodiment exemplifies the case where the third sacrificial anode layers 22 and 32 of the first refrigerant pipe 20 and the second refrigerant pipes 30 are made of the identical material. Alternatively, the first refrigerant pipe 20 and the third sacrificial anode layer 32 of each of the second refrigerant pipes 30 may be made of materials different from each other. The third sacrificial anode layer 22 of the first refrigerant pipe 20 has only to be made of a metal electrochemically inferior to the first core material 21, and the third sacrificial anode layer 32 of each of the second refrigerant pipes 30 has only to be made of a metal electrochemically inferior to the second core material 31.

The above embodiment exemplifies the case where first sacrificial anode layer 54 and the second sacrificial anode layer 64 are made of the material for the third sacrificial anode layers 22 and 32. These layers may alternatively be made of materials different from each other. In a case where the first sacrificial anode layer 54, the second sacrificial anode layer 64, and the third sacrificial anode layers 22 and 32 are each made of an aluminum alloy, the materials may be differentiated by differentiating types of metals other than aluminum contained in the alloys and/or differentiating compounding ratios of metals. For example, the first sacrificial anode layer 54 may be made of a material electrochemically inferior to the third sacrificial anode layer 22, and the second sacrificial anode layer 64 may be made of a material electrochemically inferior to the third sacrificial anode layer 32.

(4-4) Modification Example 1D

The above embodiment exemplifies the case where the body 40, the first core material 21 of the first refrigerant pipe 20, and the second core materials 31 of the second refrigerant pipes 30 are made of the identical material. These elements may alternatively be made of materials different from one another. In a case where the body 40, the first core material 21, and the second core materials 31 are each made of an aluminum alloy, the body 40, the first core material 21, and the second core materials 31 may be made of materials different from one another by differentiating types of metals other than aluminum contained in the alloys and/or differentiating compounding ratios of metals.

(4-5) Modification Example 1E

The above embodiment exemplifies the case where the first refrigerant pipe 20, the second refrigerant pipes 30, the first core material 21, and the second core materials 31 each have the circular tube shape. Each of the first refrigerant pipe 20, the second refrigerant pipes 30, the first core material 21, and the second core materials 31 may alternatively have a tubular shape other than the circular tube shape, such as an elliptical sectional shape perpendicular to a refrigerant flow direction.

(4-6) Modification Example 1F

The above embodiment exemplifies the case where the body 40 is constituted by the first member 43 and the second member 44. The body 40 may alternatively be constituted by three or more members, or by a single member.

(4-7) Modification Example 1G

The above embodiment exemplifies the case where the third sacrificial anode layers 22 and 32 are inserted to the circular openings 45*b* and 47*b*, respectively. Alternatively, the third sacrificial anode layers 22 and 32 may not be inserted to the circular openings 45*b* and 47*b*. The third sacrificial anode layers 22 and 32 may be removed at parts of the first refrigerant pipe 20 and the second refrigerant pipes 30 inserted to the circular openings 45*b* and 47*b*. The first sacrificial anode layer 54 and the second sacrificial anode layer 64 evenly inhibit corrosion of the body 40 even in such a configuration.

(4-8) Modification Example 1H

The above embodiment exemplifies the case where the first plate 50 includes the first plate-shaped core material 53 and the first sacrificial anode layer 54, and the second plate 60 includes the second plate-shaped core material 63 and the second sacrificial anode layer 64. Other than the above configuration, corrosion of the third sacrificial anode layers 22 and 32 extending into the circular openings 45*b* and 47*b* can be prevented even in a case where the first plate-shaped core material 53 and the first sacrificial anode layer 54 of the first plate 50 are constituted by a single layer made of a material and the second plate-shaped core material 63 and the second sacrificial anode layer 64 of the second plate 60 are constituted by a single layer made of a material.

(4-9) Modification Example 1I

The above embodiment provides the fool proof structures exemplified by the projections 57 and 67 on the first plate 50 and the second plate 60. The fool proof structures are not limited to these projections 57 and 67. For example, the second principal surfaces 52 and 62 of the first plate 50 and the second plate 60 may have inscriptions. In a case where the second principal surfaces have inscriptions such as letters "joined surface", erroneous joining of the first principal surface 51 or 61 to the first surface 41 or the second surface 42 of the body 40 will inevitably indicate the letters "joined surface" to the assembling worker for prevention of erroneous assembly. Still alternatively, the first surface 41 and the second surface 42 of the body 40 may have convex curved shapes and the second principal surfaces 52 and 62 of the first plate 50 and the second plate 60 may have concave curved shapes. Such fool proof structures prevent erroneous assembly in a case where the first principal surface 51 or 61 having the convex curved shape of the first plate 50 or the second plate 60 is joined to the first surface 41 or the second surface 42 having the convex shape. In this case, the first plate 50 or the second plate 60 is lifted because the first principal surface 51 or 61 does not match the first surface 41 or the second surface 42.

The embodiment of the present disclosure has been described above. Various modifications to modes and details should be available without departing from the purpose and the scope of the present disclosure recited in the claims.

What is claimed is:

1. A refrigerant distributor comprising:

a first refrigerant pipe allowing a refrigerant to flow therethrough;

a plurality of second refrigerant pipes allowing the refrigerant to flow therethrough;

a body made of aluminum or an aluminum alloy, the body having a first surface connected to the first refrigerant pipe and a second surface connected to the plurality of second refrigerant pipes, and the body being configured to distribute the refrigerant flowing from the first refrigerant pipe into the plurality of second refrigerant pipes or merge the refrigerant flowing from each of the second refrigerant pipes into the first refrigerant pipe;

the body including a first member made of aluminum or an aluminum alloy and having a cylindrical shape, and a second member having a concave portion receiving the first member and made of a material of the first member, the first member having the first surface on a side opposite to a side fitted into the concave portion, the second member having the second surface on a side opposite to the concave portion, and the concave portion receiving the first member having an internal space for distribution of the refrigerant;

a first plate joined to the first surface, the first plate having an outer surface that is exposed to atmosphere, and the outer surface of the first plate being provided with a first sacrificial anode layer for the body; and a second plate joined to the second surface, the second plate having an outer surface that is exposed to atmosphere, and the outer surface of the second plate being provided with a second sacrificial anode layer for the body, the first member and the first plate having a first fitting hole provided in the first surface and receiving the first refrigerant pipe, and the second member and the second plate having a plurality of second fitting holes provided in the second surface and receiving the plurality of second refrigerant pipes.

2. The refrigerant distributor according to claim 1, wherein the first refrigerant pipe and the plurality of second refrigerant pipes include a first core material and second core materials each made of aluminum or an aluminum alloy and having a circular tube shape, and third sacrificial anode layers provided on outer circumferential surfaces of the first core material and the second core materials for the first core material and the second core materials.

3. The refrigerant distributor according to claim 1, wherein the first plate and the second plate have fool proof structures preventing a side of surface provided with the first sacrificial anode layer and a side of surface provided with the second sacrificial anode layer from joining to the first surface and the second surface, respectively, the fool proof structures being selected from the group consisting of a projection extending outwardly from each of the first and second plates, an inscription on each of the first and second plates, and each of the first and second plates having a shape corresponding to a shape of the respective first and second surfaces.

4. The refrigerant distributor according to claim 1, wherein the first plate includes a first plate-shaped core material electrochemically superior to the first sacrificial anode layer, and the first sacrificial layer is provided directly on the first plate-shaped core material, the second plate includes a second plate-shaped core material electrochemically superior to the second sacrificial anode layer, and the second sacrificial layer is provided directly on the second plate-shaped core material.

5. The refrigerant distributor according to claim 4, wherein the body is made of an aluminum alloy, and the first plate-shaped core material and the second plate-shaped core material are made of a material of the body.

6. The refrigerant distributor according to claim 1, wherein the first plate and the first surface are joined by a brazing filler metal, and the second plate and the second surface are joined by a brazing filler metal.

7. An air conditioner including the refrigerant distributor according to claim 1.

8. The refrigerant distributor according to claim 2, wherein the first plate and the second plate have fool proof structures preventing a side of surface provided with the first sacrificial anode layer and a side of surface provided with the second sacrificial anode layer from joining to the first surface and the second surface, respectively, the fool proof structures being selected from the group consisting of a projection extending outwardly from each of the first and second plates, an inscription on each of the first and second plates, and each of the first and second plates having a shape corresponding to a shape of the respective first and second surfaces.

9. The refrigerant distributor according to claim 2, wherein the first plate includes a first plate-shaped core material electrochemically superior to the first sacrificial anode layer, and the first sacrificial layer is provided directly on the first plate-shaped core material, the second plate includes a second plate-shaped core material electrochemically superior to the second sacrificial anode layer, and the second sacrificial layer is provided directly on the second plate-shaped core material.

10. The refrigerant distributor according to claim 2, wherein the first plate and the first surface are joined by a brazing filler metal, and the second plate and the second surface are joined by a brazing filler metal.

11. An air conditioner including the refrigerant distributor according to claim 2.

12. A refrigerant distributor comprising:

a first refrigerant pipe allowing a refrigerant to flow therethrough:

a plurality of second refrigerant pipes allowing the refrigerant to flow therethrough;

a body made of aluminum or an aluminum alloy, the body having a first surface connected to the first refrigerant pipe and a second surface connected to the plurality of second refrigerant pipes, and the body being configured to distribute the refrigerant flowing from the first refrigerant pipe into the plurality of second refrigerant pipes or merge the refrigerant flowing from each of the second refrigerant pipes into the first refrigerant pipe;

the body including a first member made of aluminum or an aluminum alloy and having a cylindrical shape, and a second member having a concave portion receiving the first member and made of a material of the first member, the first member having the first surface on a side opposite to a side fitted into the concave portion, the second member having the second surface on a side opposite to the concave portion, and the concave portion receiving the first member having an internal space for distribution of the refrigerant;

a first plate joined to the first surface, the first plate having an outer surface that is exposed to atmosphere, and the outer surface of the first plate being provided with a first sacrificial anode layer for the body; and a second plate joined to the second surface, the second plate having an outer surface that is exposed to atmosphere, and the outer surface of the second plate being provided with a second sacrificial anode layer for the body, the first sacrificial anode layer not contacting the first member, and the second sacrificial layer not contacting the second member, the first member and the first plate having a first fitting hole provided in the first surface and receiving the first refrigerant pipe, and the second member and the second plate having a plurality of second fitting holes provided in the second surface and receiving the plurality of second refrigerant pipes.

13. A refrigerant distributor comprising:

a first refrigerant pipe allowing a refrigerant to flow therethrough;

a plurality of second refrigerant pipes allowing the refrigerant to flow therethrough;

a body made of aluminum or an aluminum alloy, the body having a first surface connected to the first refrigerant pipe and a second surface connected to the plurality of second refrigerant pipes, and the body being configured to distribute the refrigerant flowing from the first refrigerant pipe into the plurality of second refrigerant pipes or merge the refrigerant flowing from each of the second refrigerant pipes into the first refrigerant pipe;

a first plate joined to the first surface, the first plate having an outer surface that is exposed to atmosphere, and the outer surface of the first plate being provided with a first sacrificial anode layer for the body; and a second plate joined to the second surface, the second plate having an outer surface that is exposed to atmosphere, and the outer surface of the second plate being provided with a second sacrificial anode layer for the body, the first and second surfaces not contacting the first sacrificial anode layer, the second sacrificial anode layer, and any other sacrificial anode layer face-to-face.

* * * * *